United States Patent [19]

Gray

[11] 4,106,770

[45] Aug. 15, 1978

[54] HYPODERMIC SYRINGE PROJECTILE

[76] Inventor: John M. Gray, 323 Wellesley Rd., Syracuse, N.Y. 13207

[21] Appl. No.: 719,658

[22] Filed: Sep. 1, 1976

[51] Int. Cl.[2] ..... A63B 65/02; A61M 5/20

[52] U.S. Cl. ..... 273/106.5 D; 128/215

[58] Field of Search ..... 273/106.5 R, 106.5 D; 128/215; 102/92

[56] References Cited

U.S. PATENT DOCUMENTS

| | | | |
|---|---|---|---|
| 2,348,337 | 5/1944 | Francis | 102/92 |
| 2,620,190 | 12/1952 | Bean | 273/106.5 R |
| 2,854,925 | 10/1958 | Crockford et al. | 273/106.5 D |
| 3,006,649 | 10/1961 | Gesick et al. | 273/106.5 D |
| 3,605,744 | 9/1971 | Dwyer | 128/215 X |
| 3,742,948 | 7/1973 | Post et al. | 128/215 X |

*Primary Examiner*—Paul E. Shapiro
*Attorney, Agent, or Firm*—Warren D. Flackbert

[57] ABSTRACT

A hypodermic syringe projectile for animal usage characterized by a hollow housing which receives an axially movable body member. A chamber for receiving treatment liquid is defined between an end of the body member and an end of the housing which mounts an injection needle. The body member is retained in a fully retracted or filled position by flexible fingers on a wall thereof which selectively engage an end of the housing and which are maintained in such retained position by a weight. Movement of the weight upon impact with an animal releases the body member for movement from the retained position and forces the treatment liquid from the chamber through the injection needle.

6 Claims, 5 Drawing Figures

HYPODERMIC SYRINGE PROJECTILE

As is known, with the increased concern over wildlife and conservation, the development of a projectile type syringe has placed importance in the humane tranquilization and treatment of animals. The disadvantages of currently used syringe equipment seemingly outweigh the advantages, noting, by way of example, that the injection afforded by one form of presently marketed syringe is accomplished by a gunpowder charge which is ignited by the impact of the syringe with the animal under treatment. With such arrangement, the possibility of severe local damage to muscle tissue arises because of the rapid rate of injection and the quantity of liquid injected.

Moreover, in view of the aforesaid rapid injection, the involved needle is barbed to prevent ejection, also resulting in the subsequent loss of part of the treatment liquid. A further difficulty presented by existing syringe equipment and associated guns is bruising and local hemorrhaging of the thick hides of the hoofed animals due to the force of impact. The need is apparent, therefore, for an alternative approach which either eliminates or minimizes the aforesaid problems.

The invention provides a hypodermic syringe projectile which injects the treatment liquid automatically upon impact with an animal in a completely mechanical manner. In this connection, the driving force of the invention is in the form of a spring, in contrast to compressed gas, chemical reaction or gunpowder as presently employed.

Briefly, the injection needle of the hypodermic syringe projectile is inserted into the desired treatment liquid and a chamber defined within the syringe barrel is filled with the liquid upon movement of an axially slideable body member, the latter compressing a drive spring. When the body member reaches a fully retracted or filled position, a retainer clip or finger thereon engages a portion of the syringe barrel, allowing a spring positioned sliding weight to move and to maintain the body member in the retracted position.

Various means may be employed to project the syringe to the animal under treatment, where, upon impact, the injection needle is driven into the animal's skin until movement of the syringe is stopped by an adjacent end of the syringe barrel. At this time, the sliding weight, by reason of momentum, continues forward movement, thus disengaging the retainer clip or finger and releasing any restraint on the body member. The drive spring then pushes the body member in the direction of the animal, forcing the treatment liquid from the chamber and completing the desired injection.

Other advantages afforded by the invention include a rate of injection comparable to that of a hand syringe, thereby avoiding the possibility of local damage occasioned by high impact devices. No barb is required on the injection needle because the force of the injection is not sufficient to result in expelling movement. Moreover, the unit, which typically is disposable, presents economies in manufacturing and use.

A better understanding of the present invention will become more apparent from the following description, taken in conjunction with the accompanying drawing, wherein FIG. 1 is a view in vertical section, showing the hypodermic syringe projectile of the invention in a filled or fully retracted condition;

Figure 1:
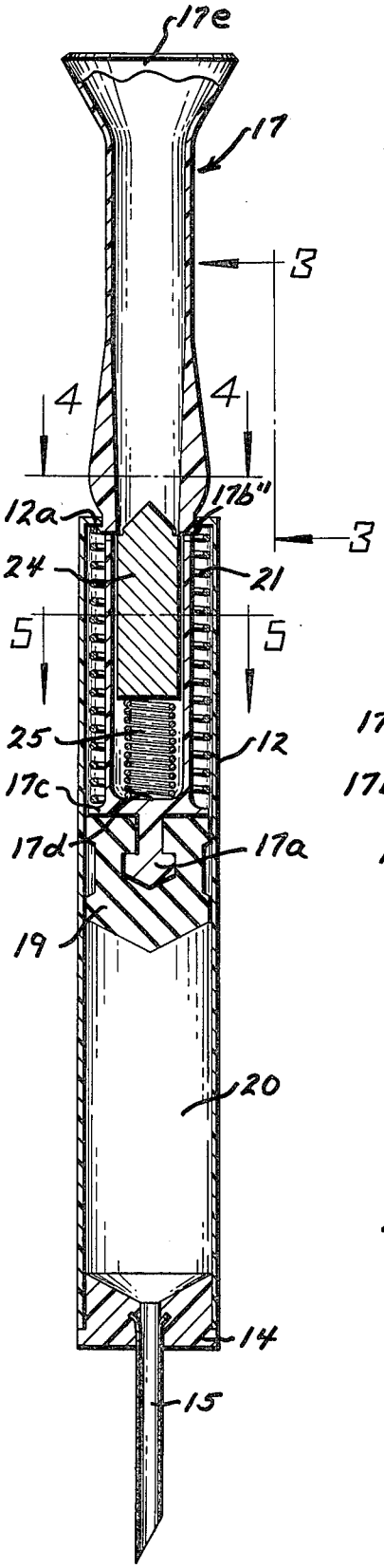
Figure 3:
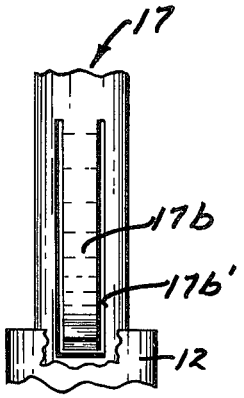
FIG. 3 is a fragmentary view in side elevation showing details of a finger or retainer forming part of the invention.
Figure 4:
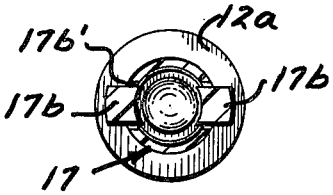
FIG. 4 is a view in horizontal section, taken at line 4—4 of FIG. 1 and looking in the direction of the arrows, showing other details of the invention; and, FIG. 5 is another view in horizontal section, taken at line 5—5 of FIG. 1 and looking in the direction of the arrows, showing still further details of the invention.
Figure 5:
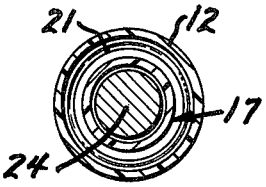

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the hypodermic syringe projectile of the invention is characterized by a hollow cylindrical housing or barrel 12 having an end plug 14 with associated injection needle 15. An elongated body member 17 is slideably received within the housing 12, where a resilient plunger 19 is attached to a projecting end portion 17*a* thereof.

The space between the end plug 14 and the plunger 19 within the housing 12 defines a chamber 20 for receiving the particular treatment liquid(s) which is to be administered. The housing 12 is typically made from a clear molded plastic resin, such as high density polyethylene, and includes graduated markings thereon (not shown) for filling, mixing, or other indicating purposes.

The body member 17 is characterized by flexible fingers 17*b* movable outwardly and inwardly in slots 17*b'* in the mid-portion thereof, typically disposed facing each other. In any event, the arrangement of the fingers 17*b* is such as to present resilient characteristics for retaining purposes, to be described herebelow.

A drive spring 21 encircles the body member 17 inside of the housing 12, being seated between an outwardly extending flange 17*c* on the body member 17 and an inwardly extending flange 12*a* at the end of the housing opposite to the injection needle 15. The drive spring 21 normally urges the body member 17 in a direction away from the flange 12*a* at the end of housing 12.

A slideable weight 24 is disposed within the body member 17, where a weight spring 25 is seated between a wall 17*d* of the body member 17 and the weight 24. The weight spring 25 continually urges the weight 24 in the direction of the fingers 17*b* and finally in engagement with a neck 17*b''* at the end of the fingers 17*b* when the latter are outside of the housing 12. The fingers 17*b*, in cooperation with the weight 24, serve to maintain the body member 17 at a fully retracted or filled syringe position.

As noted in the figures, the free end 17*e* of the body member 17 is preferably flared in an outward direction. Such configuration serves to assist in pulling action and, as well, promotes stability during projection.

Figure 2:
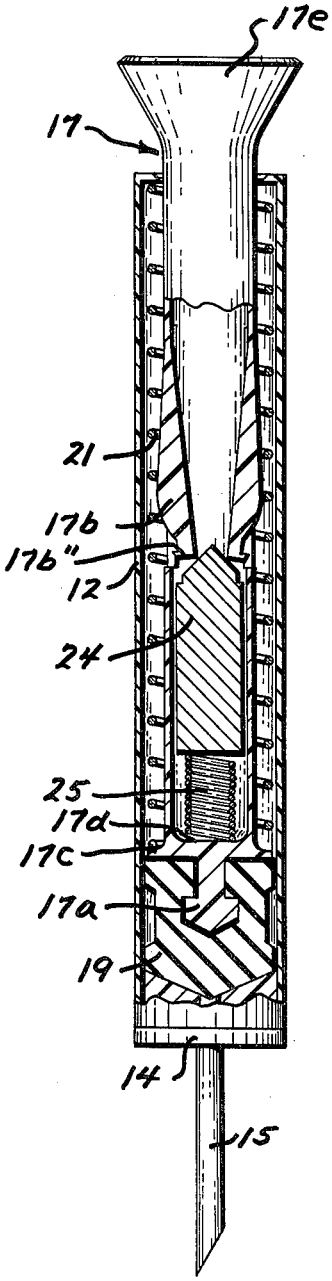
FIG. 2 is another view in vertical section, showing the hypodermic syringe projectile of FIG. 1 in a prefilled condition.

In use, and assuming the hypodermic syringe projectile is in an unfilled condition, the treatment liquid is drawn into the chamber 20 from a source (not shown)

through injection needle 15. The preceding is accomplished by axial movement of body member 17 away from the injection needle 15 and against the seated drive spring 21, compressing the latter. The weight 24 and the weight spring 25 move simultaneously with the body member 17, the weight 24 bearing against the inwardly flexed ends of the fingers 17*b* (see FIG. 2).

At a fully retracted or filled position, portions of the fingers 17*b* of the body member 17 emerge from the housing 12 and bear against the opening thereto. At this time, the weight 24 is free for further axial movement, where the position of the head of the weight 24 intermediate the fingers 17*b*, at 17*b*", prevents any inward movement or flexing of the latter. The body member 17 is then positively retained in the filled position on the end of housing 12.

With filling accomplished, various approaches may be employed for delivering the projectile toward an animal under treatment. In this connection, the preceding may include, by way of example, a light spring-powered gun, a blowgun, or even hand delivery in the manner of a target dart.

In any event, the injection needle 15 is driven into the skin of the animal until stopped by the end plug 14. At the time of impact, weight 24 moves forwardly in the direction of impact, against the force of weight spring 25, permitting the release and inward flexing of the fingers 17*b* of body member 17. With the disengagement of the fingers 17*b* from the retained position with the end of housing 12, the drive spring 21 causes the movement of the plunger 19 in the body member 17, forcing treatment liquid from cavity 20 through the needle 15, and injection is completed.

As should be evident from the preceding, the invention provides a positive approach for achieving the effective hypodermic injection of an animal. The described projectile in based on a mechanical approach which affords a safe speed of injection and couples ease in filling and in use. The invention lends itself to ready manufacturing, is light in weight, and while designed as disposable may, with proper choice of material, be sterilized for reuse.

The described hypodermic syringe projectile is susceptible to various changes within the spirit of the invention. In this connection, the hypodermic syringe projectile could be supplied in various injection needle lengths, i.e. suitable for use with various size animals. Additionally, the overall unit can be reproportioned as, for example, to achieve a larger or smaller liquid chamber than indicated in the figures. Thus, the preceding should be considered illustrative and not as limiting the scope of the following claims:

I claim:

1. A hypodermic syringe projectile comprising a hollow housing, a body member movable within said housing along the longitudinal axis extending from one end of the projectile to the other, a needle extending from one end of said housing, means urging said body member in the direction of said needle, a flexible finger arranged in a side wall of said body member and movable from a non-retaining position to a retaining position, means normally biasing said finger to said non-retaining position, means on said housing engaging said finger at said retaining position to hold said body member rearwardly of said one end against the bias of said means urging said body member in the direction of said needle, a weight disposed for axial movement within a passageway in said body member, and means within said passageway in said body member urging said weight in the direction of said finger, said finger in said non-retaining position normally projecting into said passageway a sufficient distance to block axial movement of said weight, and said weight having a portion which flexes said finger to said retaining position.

2. The hypodermic syringe projectile of claim 1 where said body member has a plunger at one end thereof, and where a chamber is defined within said housing between said plunger and said needle.

3. The hypodermic syringe projectile of claim 1 where movement of said weight in the direction of said needle disengages said weight from said finger and permits movement of said finger from said retaining position to said non-retaining position.

4. The hypodermic syringe projectile of claim 1 where said body member urging means is a spring encircling said body member and extending between a portion of said body member and the other end of said housing.

5. The hypodermic syringe projectile of claim 1 where said weight urging means is a spring.

6. The hypodermic syringe projectile of claim 1 where said flexible finger is a tongue movable within a slot in said side wall of said body member.

* * * * *